US008246526B2

(12) United States Patent
Roth et al.

(10) Patent No.: US 8,246,526 B2
(45) Date of Patent: Aug. 21, 2012

(54) COVERING LAYER FOR ELECTROPHOTOGRAPHIC PRINTING ROLLERS

(75) Inventors: Christoph Roth, Halle (DE); Regina Lischewski, Wolfen OT Reuden (DE); Roland Ackermann, Bitterfeld (DE); Wolfgang Witt, Wolfen OT Reuden (DE)

(73) Assignee: Sensient Imaging Technologies GmbH, Wolfen (DE)

( * ) Notice: Subject to any disclaimer, the term of this patent is extended or adjusted under 35 U.S.C. 154(b) by 978 days.

(21) Appl. No.: 11/910,168

(22) PCT Filed: Mar. 28, 2006

(86) PCT No.: PCT/EP2006/061098

§ 371 (c)(1),
(2), (4) Date: Jan. 3, 2008

(87) PCT Pub. No.: WO2006/103235

PCT Pub. Date: Oct. 5, 2006

(65) Prior Publication Data

US 2008/0166157 A1 Jul. 10, 2008

(30) Foreign Application Priority Data

Mar. 30, 2005 (DE) ..... 10 2005 014 958

(51) Int. Cl.
*G03G 15/20* (2006.01)
*G03G 5/147* (2006.01)

(52) U.S. Cl. ..... 492/56; 492/53; 492/48; 399/176; 399/286

(58) Field of Classification Search ..... 492/48, 492/59, 56, 53; 399/286, 279, 280, 176
See application file for complete search history.

(56) References Cited

U.S. PATENT DOCUMENTS

| | | | | |
|---|---|---|---|---|
| 4,100,134 | A * | 7/1978 | Robins et al. | 528/10 |
| 4,201,852 | A * | 5/1980 | Dieterich | 528/67 |
| 4,241,116 | A * | 12/1980 | Taniyama et al. | 427/386 |
| 4,343,855 | A * | 8/1982 | Conder | 428/332 |
| 4,378,250 | A * | 3/1983 | Treadway et al. | 106/287.11 |
| 5,225,471 | A * | 7/1993 | Tajima et al. | 524/284 |
| 5,314,980 | A * | 5/1994 | Morrison | 528/19 |
| 5,411,339 | A * | 5/1995 | Bahrabadi et al. | 400/56 |
| 5,888,644 | A * | 3/1999 | Yoshida et al. | 428/323 |
| 6,218,482 | B1 * | 4/2001 | Yamanaka et al. | 525/524 |
| 6,321,062 | B1 * | 11/2001 | Kitano et al. | 399/333 |
| 6,361,868 | B1 * | 3/2002 | Bier et al. | 428/428 |
| 6,495,300 | B1 * | 12/2002 | Qi et al. | 430/66 |
| 6,686,047 | B2 * | 2/2004 | Yamaguchi et al. | 428/407 |
| 6,689,468 | B2 * | 2/2004 | Edelmann et al. | 428/403 |
| 6,699,586 | B2 * | 3/2004 | Edelmann et al. | 428/447 |
| 6,737,162 | B2 * | 5/2004 | Jonas et al. | 428/413 |
| 6,771,920 | B2 * | 8/2004 | Abe et al. | 399/176 |
| 6,780,232 | B2 * | 8/2004 | Treadway | 106/287.12 |
| 6,824,875 | B2 * | 11/2004 | Bier et al. | 428/414 |
| 6,830,816 | B2 * | 12/2004 | Mehnert et al. | 428/423.1 |
| 6,935,994 | B2 * | 8/2005 | Nakano | 492/56 |
| 7,037,585 | B2 * | 5/2006 | Treadway | 428/413 |
| 7,268,176 | B2 * | 9/2007 | Ambrose et al. | 524/262 |
| 7,345,108 | B2 * | 3/2008 | Ambrose et al. | 524/493 |
| 2003/0114556 | A1 * | 6/2003 | Jennrich et al. | 523/400 |
| 2004/0146653 | A1 * | 7/2004 | Diego et al. | 427/387 |
| 2006/0052628 | A1 * | 3/2006 | Wiesendanger et al. | 560/220 |
| 2007/0093576 | A1 * | 4/2007 | Albrecht et al. | 524/261 |
| 2007/0191513 | A1 * | 8/2007 | Jenrich et al. | 523/443 |

FOREIGN PATENT DOCUMENTS

DE 2315249 A1 10/1973

OTHER PUBLICATIONS

Lucca Prezzi et al., Network density Control in Epoxy-Silica Hybrids by Selective Silan Functionalization of Precursors, Institute of Polymer Technology and Materials Engineering, Advances in Polymer Technology, vol. 24 May 4, 2004.*

Preparation of Scratch and Abrasion Reistant Polymeric Nanocomposites by Monomer Grafting onto Nanoparticles, Frank Bauer et al., Macromol. Mater. Eng. 2002, 287, 546-552, Wiley-VCH Verlag GmbH & Co.*

* cited by examiner

*Primary Examiner* — David Bryant
*Assistant Examiner* — Jason L Vaughan
(74) *Attorney, Agent, or Firm* — Michael Best & Friedrich LLP

(57) ABSTRACT

The invention relates to a novel covering layer for electrophotographic printing rollers with improved scratch resistance. Said covering layer consists of between 50 and 75 wt. % of cycloaliphatic epoxides, between 20 and 60 wt. % of aminofunctional silica nanoparticles, and between 0 and 2 wt. % of perfluoroalkyltrialkoxysilanes. The aminofunctional nanoparticles are produced from aminoalkyltrialkoxysilanes preferably by means of sol/gel technology.

9 Claims, No Drawings

COVERING LAYER FOR ELECTROPHOTOGRAPHIC PRINTING ROLLERS

CROSS-REFERENCE TO RELATED APPLICATIONS

This patent application is a national stage filing under 35 U.S.C. 371 of International Application No. PCT/EP2006/061098, filed 28 Mar. 2006, which claims foreign priority to German Patent Application No. 10 2005 014 958.8, filed 30 Mar. 2005, the disclosures of which are incorporated by reference herein in their entireties. Priority to each application is hereby claimed.

FIELD OF THE INVENTION

The invention relates to a novel covering layer for electrophotographic printing rollers with improved scratch resistance. The new covering layer is suitable for copier and printer rollers.

RELATED ART

Electrophotography is a process widely used in printing and duplicating technology. The basis of electrophotography is that charges are released in a charge generation layer following exposure, which charges are capable of converting a previously applied charge into an image of charges. Using charged toner particles, it is possible to produce an image on the roller, which is transferred to paper after contacting. To achieve high adhesion and stability on paper supports, the charged toner particles are embedded in special resins which, once transferred onto paper, can be thermally fixed.

In general, electrophotographic printing rollers consist of an aluminum cylinder provided with an adhesive layer having applied thereto:

a) a charge generation layer 0.2 to 3 μm in thickness,
b) a charge transport layer 10 to 40 μm in thickness,
c) a covering layer 0.5 to 5 μm in thickness.

As light-sensitive layer, the charge generation layer frequently includes phthalocyanine compounds such as titanoylphthalocyanine in dispersed form in a polymer matrix. The polymer matrix usually is a synthetic resin binder based on polycarbonate, polyester, polyamide, polyepoxide, polysilicone resin or copolymers on the basis of acrylic or methacrylic esters.

The charges generated in that layer are taken up by the charge transport layer and transferred to the surface. Under dark conditions, the charge transport layer is intended to retain the charges just like an insulating layer. This is generally done by hydrazone compounds likewise dispersed in special resins. The covering layer acts as a protective layer and has a substantial influence on the printing result. In particular, the covering layer is to protect the printing roller surface from mechanical damage by toner particles and paper. In addition, it should satisfy requirements such as

- high transparency
- well-adapted electrical properties such as low transverse conductivity, no insulator function, specific residual potential, etc.;
- high solvent resistance, preferably with barrier function to allow the use of fluid toner;
- easy cleaning properties, no undesirable adhesion of toner particles;
- high oxidation resistance, low sensitivity to ozone and nitrogen oxides formed during charging.

The use of ABS resins, phenol resins, polyester, polycarbonate, polyamide, silicon resins or acrylic resins for such protective layers is well-known. EP 1 030 223 describes crosslinked polysiloxanes in combination with dihydroxymethyltriphenylamine and methyltrimethoxysilane.

U.S. Pat. No. 6,495,300 suggests the use of trialkoxysilyl-functionalized hydroxyalkyl acrylates in combination with aerosil pigments. EP 1 271 253 suggests pigmented protective layers based on phenol resins and teflon dispersions. Addition of fluorosilane coupling agents achieves good anchoring of the antimony-zinc oxide pigments and good lubricity.

It is also well-known to use teflon particles as lubricants in binder mixtures of polyurethane resin and polyvinylbutyral.

JP 2004-020649 (Abstract) suggests the use of aromatic N-substituted polyepoxides in combination with silane mixtures of phenyltriethoxysilane, methyltriethoxysilane and aminopropyltriethoxysilane.

Protective layers having a controllable residual potential have also been described. Inter alia, polycarbonate is used as polymer resin. The lack of scratch resistance is to be compensated by using 20 to 60 wt.-% perfluoroalkyl resin particles.

Protective layers where curing proceeds via photopolymerization of epoxides, vinyl ethers or cyclic ether monomers are also well-known. In the presence of cationic photoinitiators such as triphenylsulfonium hexafluoroantimonate, polymer formation proceeds following thermal drying and UV irradiation.

Known methods represent compromise solutions, satisfying the demands on covering layers only in part. The aim and object of the present invention is to develop a new scratch-resistant protective layer which is thermally curable, does not contain any toxic aromatic amines, and has a high barrier effect to ensure the use of fluid toners.

DETAILED DESCRIPTION OF THE INVENTION

According to the invention, said object is accomplished by means of a protective layer made of a) 50 to 75 wt.-% cycloaliphatic polyfunctional epoxides;
b) 20 to 60 wt.-% amino-functional silica nanoparticles;
c) 0 to 2 wt.-% perfluoroalkyltrialkoxysilane.

The cycloaliphatic epoxides can be used both as monomers and polymers. However, the epoxide functionality must be at least two.

Examples of such compounds are:

hydrogenated bisphenol A diglycidyl ether,
hydrogenated bisphenol F diglycidyl ether,
hexahydrophthalic acid diglycidyl ether.

To avoid solvent attack of the charge transport layer, the epoxides are used in the form of 10 to 35 wt.-% solutions in isopropanol, n-butanol or methoxypropanol.

Surprisingly, aliphatic epoxides such as trimethylolpropane triglycidyl ether, hexanediol diglycidyl ether or pentaerythritol tetraglycidyl ether are unsuitable because they give rise to disadvantageous electric layer properties which prevent printing of single dots. The residual potential in such layers is determined to be 0 to 5 Volts.

Similarly, aromatic epoxides are unsuitable in the meaning of the invention because they require the use of ketones and aromatics as solvents. Such solvents frequently give rise to layer disorders by slightly dissolving the charge transport layer.

The synthesis of the amino-functional silica nanoparticles proceeds in a well-known manner using sol/gel technology wherein aminoalkyltrialkoxysilanes are hydrolyzed in alcohols and condensed to form solid particles.

Examples of aminoalkylsilanes are:

aminopropyltriethoxysilane, aminopropyltrimethoxysilane, or

N-(2-aminoethyl)-3-aminopropyltrimethoxysilane or mixtures thereof.

According to the invention, it is also possible to use amino-functional silica nanoparticles produced by functionalizing the surface of aerosils according to DE 3 212 771, DE 3 709 501, U.S. Pat. No. 3,986,997.

In addition to the amino-functional silica nanoparticles, the composition according to the invention may include up to 2 wt.-% of a perfluoroalkyltrialkoxysilane.

Examples of such fluorosilanes are:

tridecafluorooctyltriethoxysilane or the perfluoropolyethersilanes Fluorolink 7007 and Fluorolink S 10 from the Solvay Company.

In general, the particle size of the silica nanoparticles ranges from 5 to 40 nm, preferably from 5 to 20 nm.

The amino-functional silica nanoparticles have high reactivity towards epoxides, so that the nanoparticles must be stored separately from the epoxide solutions and handled as a two-component system. Mixing advantageously proceeds in such a way that the epoxide component is supplied first and the amine component is added thereto with stirring. Following intense mixing, coating of the printing rollers may proceed in a well-known manner using spray, immersion or knife coating. Depending on the concentration of the components, a pot time of 8 to 120 hours is possible. Thereafter, gelling takes place.

Following coating, the layer is vented for 15 min at room temperature or elevated temperature and cured at 110 to 130° C. for about 30 min. Such thermal curing results in a highly crosslinked hybrid polymer with covalently bound silica nanoparticles.

The covering layers of the invention are transparent, solvent-resistant and remarkable for their substantially improved scratch resistance. They allow good adjustment of the residual potential and provide high detail rendering. The nanoparticles do not require dispersing which involves high effort and frequently is difficult to reproduce. The covering layers are suitable for both dry and fluid toners.

With reference to the examples, the invention will be illustrated in more detail below.

EXAMPLES

Example 1

Production of Amino-Functional Silica Nanoparticles (Sol A)

180 ml of isopropanol and 180 ml of n-butanol are mixed in a temperature-controlled stirred vessel at room temperature. The mixture is added with 80 ml of aminopropyltriethoxysilane and 40 ml of distilled water, and stirring is continued for 30 min.

Thereafter, the temperature is increased to 50° C. and stirring is continued for 6 hours. A sol having the following characteristic values is obtained:

Solids content: 9.6% pH value: 11.0

Particle size: 5 nm

Example 2

Production of Amino-Functional Silica Nanoparticles (Sol B)

The procedure is as in Example 1, with aminopropyltriethoxysilane being replaced by 80 ml of N-(2-aminoethyl)-3-aminopropyltrimethoxysilane. A sol having the following characteristic values is obtained:

Solids content: 13.2% pH value: 11.2

Particle size: 8 nm

Example 3

Comparative Example, Sol C

The procedure is as in Example 1, the following composition being used:

180 ml of isopropanol 180 ml of n-butanol 30 ml of phenyltriethoxysilane 60 ml of tetraethoxysilane 45 ml of 0.1 N trifluoroacetic acid A sol having the following characteristic values is obtained:

Solids content: 7.3% pH value: 2.9

Particle size: 7 nm

Example 4

Determination of Hardness and Scratch Resistance on Model Covering Layers

The following solutions are coated on polyester film by dipping:

4/1: Polycarbonate Z 200 (Bayer) as 5% solution in methylene chloride

4/2: Sol C

4/3: 50 g of hydrogenated bisphenol A diglycidyl ether (10% in isopropanol)

26.8 g of sol A

4/4: 50 g of hydrogenated bisphenol A diglycidyl ether (10% in isopropanol)

27.5 g of sol B

4/5: 50 g of hexahydrophthalic acid diglycidyl ether (10% in methoxypropanol)

33.5 g of sol A

4/6: 50 g of hexahydrophthalic acid diglycidyl ether (10% in isopropanol)

33 g of sol B 9 g of perfluoroalkylsilane Dynasylan F 8263® (1% in isopropanol).

Following air drying, the coated samples are cured for 30 min at 110° C. Characterization of the mechanical surface properties is made by determining the surface hardness according to Erichsen (ISO 15184) and by contacting the surface with a rigid polyamide tissue (Glitzi sponge, Scotch-Britt) loaded with 200 and 500 g each time. The surface damage caused by contacting is quantified using scores from 1 to 5. A score of 1 is given for completely undamaged surfaces and a score of 5 for highly damaged surfaces. The results are summarized in the following Table 1:

TABLE 1

| Coating | Hardness | Glitzi test (score) 200 g | 500 g |
|---|---|---|---|
| 4/1 | B-HB | 2 | 3 |
| 4/2 | F-H | 1 | 1 |
| 4/3 | F-H | 1 | 1 |
| 4/4 | F-H | 1 | 1 |
| 4/5 | H-2H | 1 | 1 |
| 4/6 | F-H | 1 | 1 |

TABLE 2

| Covering layer | Layer thickness (μm) | Residual potential (V) | Single dots 10 copies | 7000 copies |
|---|---|---|---|---|
| 5/1 | 3.8 | 38 | + | – |
| 5/2 | 1.9 | 0 | – | – |
| 5/3 | 2.2 | 5 | – | – |
| 5/4 | 2.5 | 65 | + | + |
| 5/5 | 2.4 | 45 | + | + |
| 5/6 | 2.4 | 15 | + | + |
| 5/7 | 2.3 | 20 | + | + |

Example 5

Conventional printing rollers for laser printers provided with a 0.8 μm thick charge generation layer on the basis of a phthalocyanine-titanium oxide complex in polyvinylbutyral as binder and a 25 μm thick charge transport layer on the basis of N,N'-bis(3-methylphenyl)-N,N'-bis(phenyl)benzidine as photoconductor and polycarbonate as binder are coated with the following protective layer compositions using dip coating:

5/1 Polycarbonate Z 200 (5% solution in methylene chloride)

5/2 Sol C

5/3 100 g of trimethylolpropane triglycidyl ether (10% in isopropanol)

78.5 g of sol A

5/4 100 g of hydrogenated bisphenol A diglycidyl ether (10% in isopropanol)

53 g of sol A

5/5 100 g of hydrogenated bisphenol A diglycidyl ether (10% in methoxypropanol)

56 g of sol B

5/6 100 g of hexahydrophthalic acid diglycidyl ether (10% in isopropanol)

60.5 g of sol A

5/7 100 g of hexahydrophthalic acid diglycidyl ether (10% in methoxypropanol)

62 g of sol B 15 g of Dynasilan F 8263 (1% in isopropanol)

Following air drying for 15 min, the layers are cured for 30 min at 110° C. The electrical properties of the covering layer are characterized by the residual potential determined according to DE 3 924 904. In addition, the reproduction of smallest printable detail information (single dots) is determined after 10 and 7000 copies. The results are summarized in Table 2.

The protective layers of the invention corresponding to compositions 5/4 to 5/7 show a substantial improvement of the printing properties. Protective layers having well-known polysiloxanes (5/2) or aliphatic epoxides do not allow printing of single dots. Protective layers on the basis of polycarbonate show significantly impaired reproduction with increasing number of copies.

The invention claimed is:

1. An electrophotographic printing roller having a covering layer comprising a) 50 to 75 wt.-% cycloaliphatic polyfunctional epoxide;

b) 20 to 50 wt.-% amino-functional silica nanoparticles; and c) 0 to 2 wt.-% perfluoroalkyltrialkoxysilane.

2. The electrophotographic printing roller according to claim 1, wherein the functionality of the epoxide in the covering layer is two.

3. The electrophotographic printing roller according to claim 1, wherein the epoxide in the covering layer comprises hydrogenated bisphenol A diglycidyl ether.

4. The electrophotographic printing roller according to claim 1, wherein the epoxide in the covering layer comprises hexahydrophthalic acid diglycidyl ether.

5. The electrophotographic printing roller according to claim 1, wherein the perfluoroalkyltrialkoxysilane in the covering layer comprises triethoxy(tridecafluorooctyl)silane.

6. The electrophotographic printing roller according to claim 1, further comprising a solvent in the covering layer.

7. The electrophotographic printing roller according to claim 6, wherein the solvent in the covering layer comprises one or more aliphatic alcohols.

8. The electrophotographic printing roller according to claim 1, wherein the aminofunctional silica nanoparticles in the covering layer are of a type produced from aminoalkylsilanes using sol/gel technology.

9. The electrophotographic printing roller according to claim 8, wherein the aminoalkylsilanes in the covering layer comprise aminopropyltriethoxysilane, aminopropyltrimethoxysilane, N-(2-aminoethyl)-3-aminopropyltrimethoxysilane or mixtures thereof.

* * * * *